US006176025B1

(12) United States Patent
Patterson et al.

(10) Patent No.: US 6,176,025 B1
(45) Date of Patent: Jan. 23, 2001

(54) CUSHIONING SYSTEM FOR GOLF SHOES

(75) Inventors: Chad Patterson, West Springfield; Joel A. Singer, Quincy, both of MA (US)

(73) Assignee: Spalding Sports Worldwide, Inc., Chicopee, MA (US)

( * ) Notice: Under 35 U.S.C. 154(b), the term of this patent shall be extended for 0 days.

(21) Appl. No.: 09/322,428

(22) Filed: May 28, 1999

(51) Int. Cl.[7] ..... A43B 13/18
(52) U.S. Cl. ..... 36/28; 36/44; 36/35 B
(58) Field of Search ..... 36/28, 29, 35 B, 36/43, 44, 71, 127

(56) References Cited

U.S. PATENT DOCUMENTS

| | | | | |
|---|---|---|---|---|
| D. 403,147 | | 12/1998 | Erickson | D2/962 |
| 3,492,744 | | 2/1970 | Bernier et al. | 36/59 |
| 3,559,308 | | 2/1971 | Bernier et al. | 36/2.5 |
| 4,316,335 | * | 2/1982 | Giese et al. | 36/28 |
| 4,580,359 | | 4/1986 | Kurrash et al. | 36/127 |
| 5,131,174 | * | 7/1992 | Drew et al. | 36/35 R |
| 5,155,927 | * | 10/1992 | Bates et al. | 36/28 |
| 5,179,792 | * | 1/1993 | Brantingham | 36/29 |
| 5,313,717 | * | 5/1994 | Allen et al. | 36/28 |
| 5,435,078 | * | 7/1995 | Pyle | 36/28 |
| 5,438,768 | * | 8/1995 | Bauerfeind | 36/43 |
| 5,575,088 | * | 11/1996 | Allen et al. | 36/28 |
| 5,625,964 | * | 5/1997 | Lyden et al. | 36/29 |
| 5,813,142 | * | 9/1998 | Demon | 36/28 |
| 5,911,491 | * | 6/1999 | Huff | 36/28 |

FOREIGN PATENT DOCUMENTS 3-50103 3/1991 (JP) .

* cited by examiner

*Primary Examiner*—M D Patterson

(57) ABSTRACT

A cushioning system for golf shoe includes a footbed having a sole region, an arch region, and a heel region. The footbed includes an upper layer which is engaged by the foot of a golfer and a lower layer. The lower layer is composed of a compressible material and includes a recess in the heel region, a plurality of receptacles in the sole region, and a receptacle in the arch region. A lasting board has a heel region defining a receptacle disposed oppositely the recess of the footbed. The cushioning elements include a plurality of first cushioning elements and a single second cushioning element. The cushioning elements are composed of a material which is more compressible than the material of the lower layer of the footbed. One of the first cushioning elements is disposed in each of the receptacles of the sole and arch regions of the footbed. The second cushioning element has an upper part disposed in the recess of the heel region of the footbed and a lower part disposed in the receptacle of the heel region of the lasting board.

13 Claims, 5 Drawing Sheets

CUSHIONING SYSTEM FOR GOLF SHOES

BACKGROUND OF THE INVENTION

The present invention relates to shoes, and more particularly to sports shoes intended for use while playing golf.

Golf shoes are typically comprised of a shoe upper which is attached to some or all of an inner sole, and an outsole. The inner sole typically includes a multi-layer footbed having an upper layer which is contacted by the golfer's foot and a cushioning layer composed of a compressible material. The cushioning layer is compressed at the pressure points imposed by the foot and generally absorbs some of the shock which is generated during the golf swing and walking. The thickness of the inner sole is limited by the requirement to maintain at least a minimal internal volume for the golf shoe. Therefore, the thickness of the cushioning layer and the relief provided by the cushioning layer is also limited.

Recreational golfers are generally free to use motorized golf carts, thereby limiting walking related stress. However, PGA rules generally prohibit the use of such golf carts during professional golfing events. The use of motorized golf carts may also be prohibited during other golfing events such as club tournaments. The stress imposed by walking the golf course can lead to fatigue which detrimentally effects the golfer's swing. Although the cushioning layers of conventional golf shoes reduce the stress to some extent, the limited nature of the relief can result in fatigue which adversely affects performance.

SUMMARY OF THE INVENTION

Briefly stated, the invention in a preferred form is a cushioning system for golf shoe which includes a footbed having a sole region, an arch region, and a heel region. The footbed includes an upper layer which is engaged by the foot of a golfer and a lower layer. The lower layer is composed of a compressible material and includes at least one receptacle. At least a part of a cushioning element is disposed within the receptacle. The cushioning element is composed of a material which is more compressible than the material of the lower layer of the footbed.

Preferably, the lower layer of the footbed has a recess in the heel region, a plurality of receptacles in the sole region, and a receptacle in the arch region. A lasting board has a heel region defining a receptacle disposed oppositely the recess of the footbed. The cushioning elements include a plurality of first cushioning elements and a single second cushioning element. One of the first cushioning elements is disposed in each of the receptacles of the sole and arch regions of the footbed. The second cushioning element has an upper part disposed in the recess of the heel region of the footbed and a lower part disposed in the receptacle of the heel region of the lasting board. In a first embodiment, each of the first cushioning elements comprises a flattened, balloon-shaped cover defining a cavity and a liquid disposed within the cavity. In a second embodiment, the lower layer of the footbed and the first cushioning elements are each composed of EVA, where the EVA of the footbed is harder than the EVA of the first cushioning elements.

The second cushioning element includes flexible upper and lower shell halves joined along an outwardly extending seam. The shell halves define a cavity which is filled with an air-gel mixture. The recess of the heel region of the footbed includes an indexing member and the upper shell half includes a complementary indexing member receiver for positioning the second cushioning element. Preferably, the indexing member includes an inner ring and a plurality of spokes which extend downwardly from the lower surface of the recess and the indexing member receiver includes an inner groove and a plurality of outwardly extending grooves having a shape which is complementary to the inner ring and spokes, respectively. The inner ring and inner groove may each have an oblong shape.

In one embodiment, the lower surface of the upper shell half is joined to the upper surface of the lower shell half within the inner groove, forming an inner cushioning pad and a separate outer cushioning ring. cushioning pad is filled with an air-gel mixture which is softer than the air-gel mixture which fills the cushioning ring. In another embodiment, the upper and lower shell halves are not joined within the inner groove. Consequently, the air-gel mixture may move between the cushioning pad and the cushioning ring.

It is an object of the invention to provide a golf shoe which has a new and improved cushioning system.

It is also an object of the invention to provide a golf shoe which has a cushioning system that provides improved cushioning in the areas of the footbed that are subject to the greatest pressure.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENTS

With reference to the drawings wherein like numerals represent like parts throughout the several figures, a cushioning system for a golf shoe in accordance with the present invention is generally designated by the numeral 10. An outsole (not shown) is mounted to an upper (not shown) to form the exterior shell of a golf shoe. The shoe upper and the outsole are well known in the art and may be comprised of any material suitable for use while playing golf. The golf shoe also includes a footbed 12, on which the golfer's foot rests, and a lasting board 14 disposed intermediate the footbed 12 and the outsole.

Figure 2:
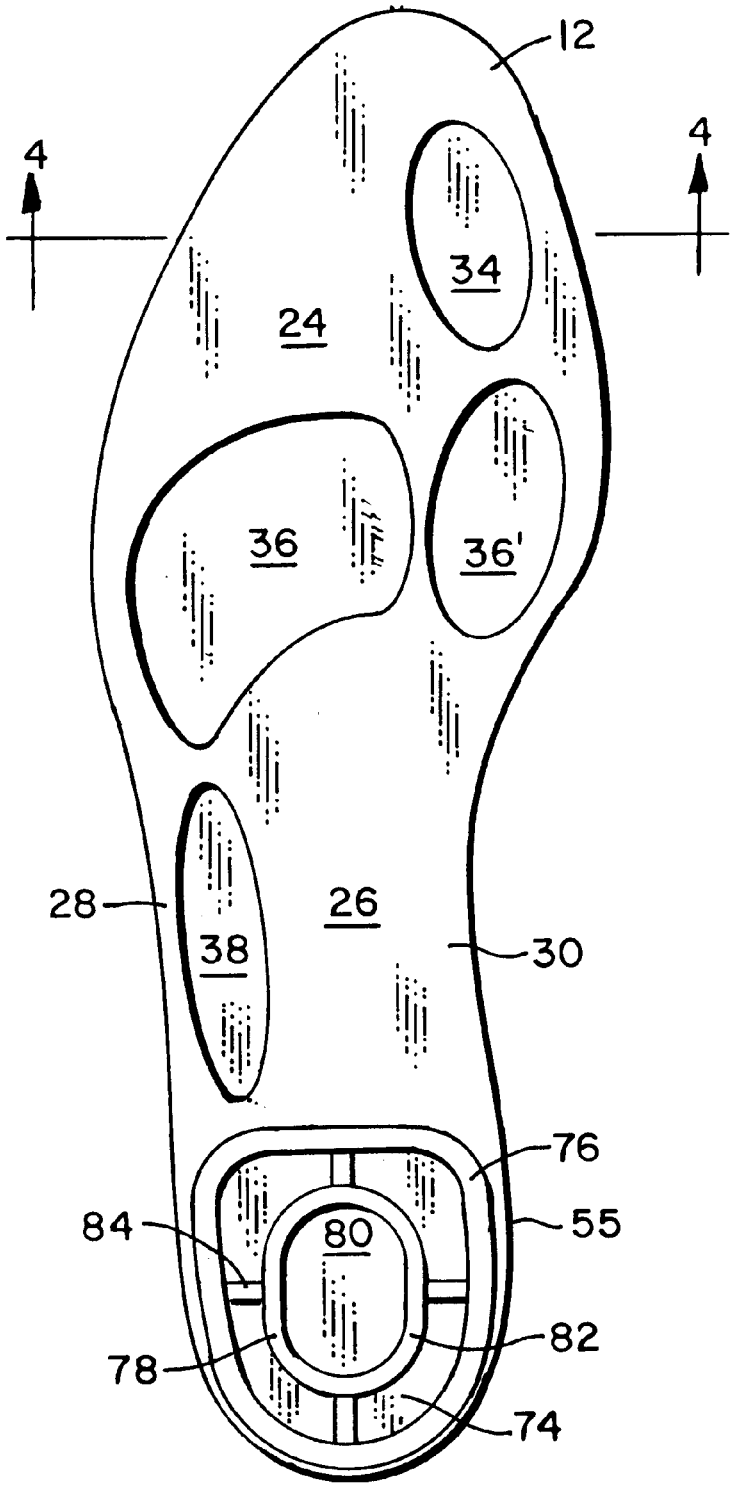
FIG. 2 is a bottom view of the footbed of FIG. 1.
Figure 3:
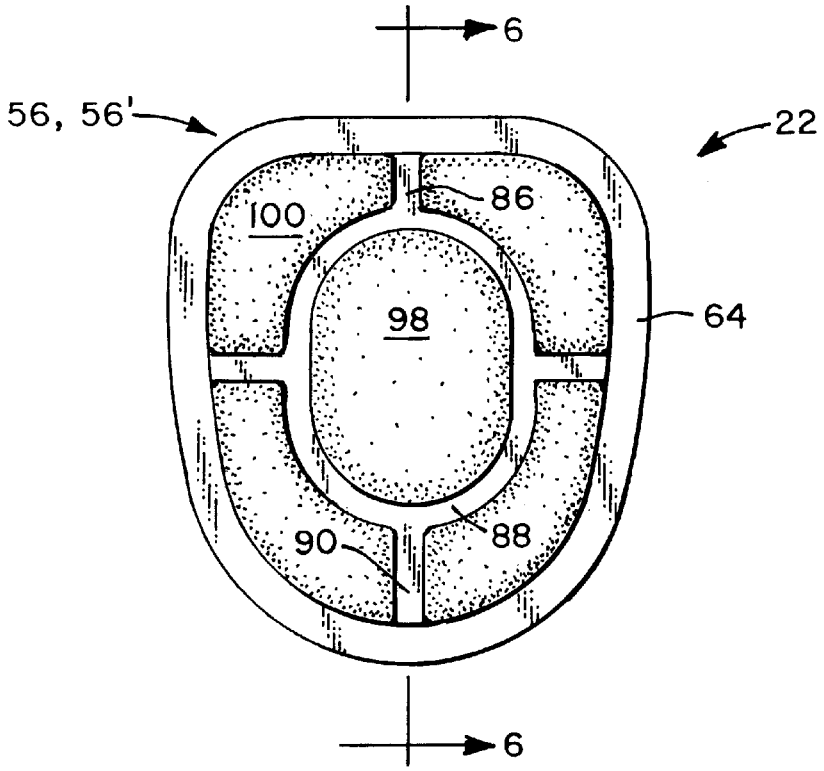
FIG. 3 is an enlarged top view of the heel cushioning pad of FIG. 1.
Figure 4:
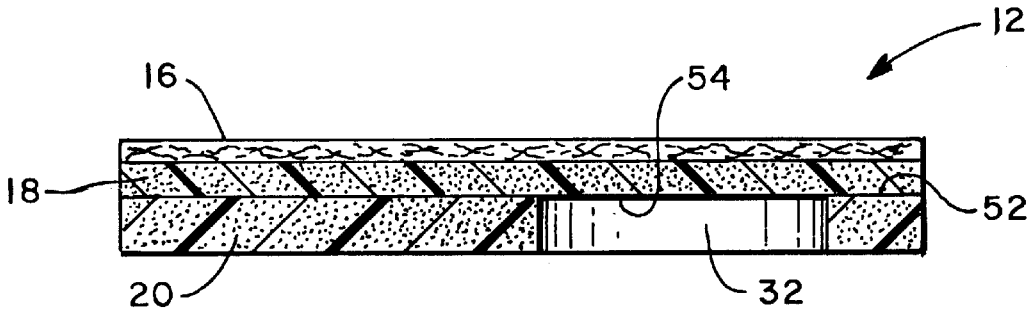
FIG. 4 is an enlarged cross-section view, taken along line 4—4 of the footbed of FIG. 2.
Figure 5:
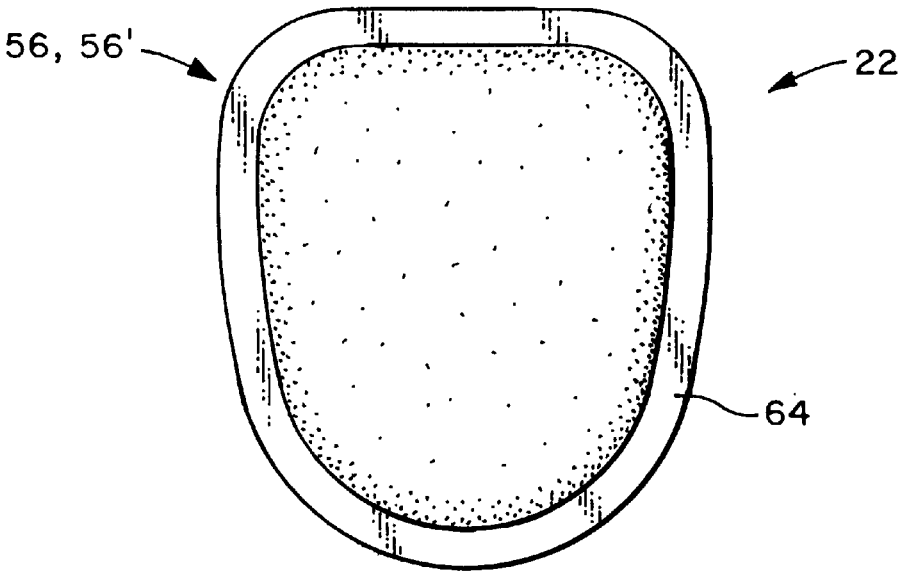
FIG. 5 is a bottom view of the heel cushioning pad of FIG. 3.

With reference to FIGS. 2 and 4, the footbed 12 has three layers, an upper layer 16 composed of cloth or similar material provides a tear-resistant outer surface on which the golfer's foot rests. A middle layer 18 composed of a relatively soft polymeric foam material provides a uniform cushion for the entire sole of the foot. A lower layer 20 is composed of a relatively firm polymeric foam material, for example ethyl-vinyl-acetate (EVA). The lower layer 20 acts as an additional cushion for the sole of the foot. However, the cushioning effect of the lower layer 20 is limited due the firmness of the layer. Preferably, the material of the middle layer 18 has an Asker C hardness of 30° and the material of the lower layer 20 has an Asker C hardness of 400. The lasting board 14 is preferably composed of thermoplastic polyurethane (TPU), supporting the foot and providing a means of diffusing the pressure induced by the spikes across the entire foot.

Although the cushioning effect provided by the middle and lower layers 18, 20 of the footbed 12 provides a generally comfortable shoe, the golfer's weight is not evenly distributed across the sole of his foot, especially during walking or a golf swing. Consequently, the cushioning system 10 of the subject invention includes cushioning elements 22 which are positioned in areas of the shoe which are subjected to the greatest amount of pressure. In the sole area 24 of the footbed 12, the big toe and the metatarsal heads of the foot subject the footbed 12 to greater pressure than the other portions of the foot. In the arch area 26 of the footbed 12, the lateral (outside) portion 28 is subject to greater pressure than the medial (inside) portion 30. To provide better comfort, the firm cushioning material of the footbed lower layer 20 is removed to form receptacles 32 for receiving softer cushioning elements 22. A receptacle 34 is positioned in the vicinity of the big toe, a pair of receptacles 36, 36' are positioned in the vicinity of the ball of the foot, and a receptacle 38 is positioned in the vicinity of the lateral portion 28 of the arch 26. As shown in FIG. 2, the area under the ball of the foot may be separated into two receptacles 36, 36'. Alternatively, a single receptacle may be formed which traverses the entire ball area.

Figure 10:
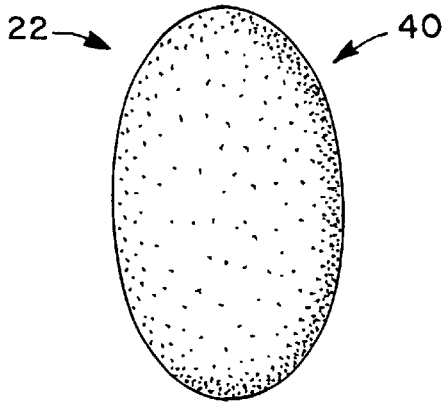
FIG. 10 is an enlarged top view of a second embodiment of the sole cushioning pad of FIG. 8.

In a first embodiment, the cushioning elements 40 (FIG. 10) are composed of a soft EVA material (having an Asker C hardness of 30°) which compresses more easily and thereby provides a greater cushioning effect than the surrounding firm EVA material. The cushioning elements 40 are preferably held in place in a conventional manner, for example by adhesive. Alternatively, the cushioning elements 40 may simply be sandwiched between the middle layer 18 of the footbed 12 and the lasting board 14.

Figure 8:
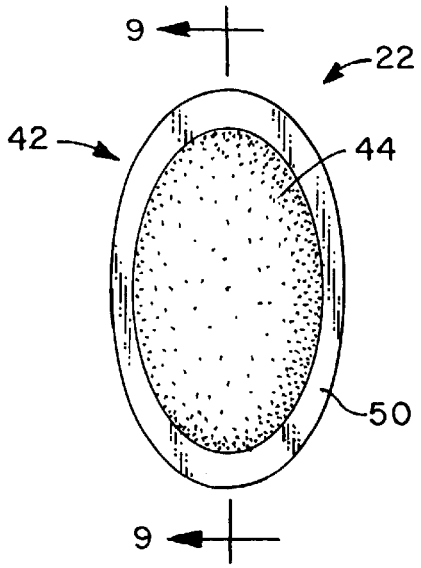
FIG. 8 is an enlarged top view of a first embodiment of one of the sole cushioning pads of FIG. 1.
Figure 9:
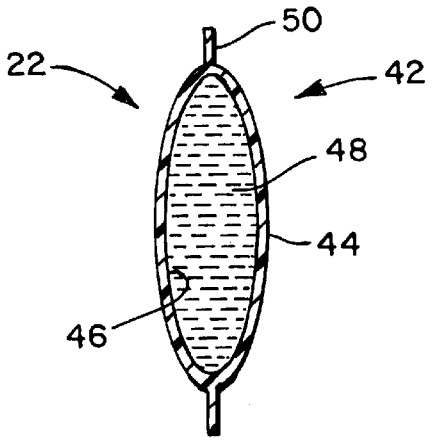
FIG. 9 is a cross-section view, taken along line 9—9, of the sole cushioning pad of FIG. 8.

In a second embodiment, the cushioning elements 42 each comprise an outer flexible cover 44 forming a cavity 46 which is filled with a liquid 48, for example gel, oil or water, see FIGS. 8 and 9. The cover 44 has the shape of a flattened balloon which is sized to occupy substantially all of the receptacle 32. A flange 50 which extends from the side of the balloon body may be mounted to the upper surface 52 of the lower layer 20 and/or the lower surface 54 of the middle layer 18 by adhesive or other means known in the art.

Figure 1:
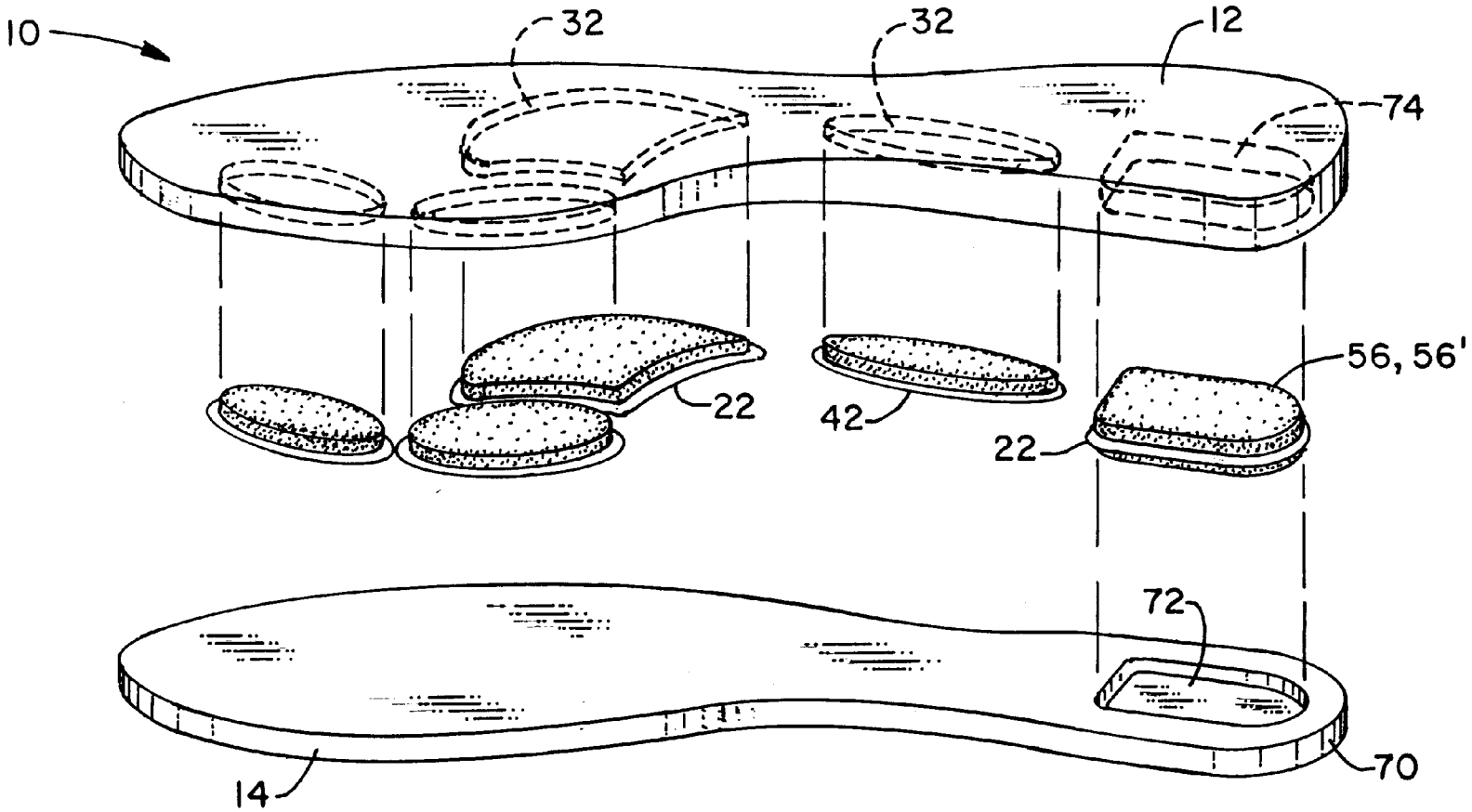
FIG. 1 is an exploded perspective view of a cushioning system in accordance with the present invention.

The heel area 55 of the footbed 12 is also subjected to high pressure. A cushioning element 56, 56' is disposed in the heel area of the shoe to absorb impact during swinging and walking to further cushion the heel of the foot. The cushioning element 56, 56' comprises a flexible shell 58 having upper and lower flexible shell halves 60, 62 which are joined along a seam 64 that forms a flange extending outwardly from the side of the element 56, 56'. The upper and lower shell halves 60, 62 form a cavity 66 which contains an air-gel mixture 68 which provides the shock-absorbing properties of gel with the cushioning properties of air. The heel 70 of the lasting board 14 has an opening 72 for receiving the lower shell half 62 and the heel 55 of the footbed 12 has a molded recess 74 for receiving the upper shell half 60, as shown in FIG. 1.

The molded recess 74 has an exterior rim 76 and an inner indexing member 78 which extend downwardly from the recessed surface 80 of the recess 74. Preferably, the indexing member 78 has in inner ring 82 and four spokes 84 which extend outwardly from the inner ring 82 to the exterior rim 76. The indexing member 78 is received in an indexing member receiver 86 to assist in positioning the cushioning element 56, 56' on the bottom surface of the footbed 12.

The indexing member receiver 86 has in inner groove 88 and four outwardly extending grooves 90 having shapes which are complementary to the shapes of the inner ring 82 and spokes 84 of the indexing member 78. The spokes 84 and grooves 90 resist rotation of the cushioning element 56, 56' relative to the footbed 12. As shown in FIG. 2, the inner ring 82 and inner groove 88 may have an oblong shape to further resist rotation of the cushioning element 56, 56' relative to the footbed 12.

Figure 6:
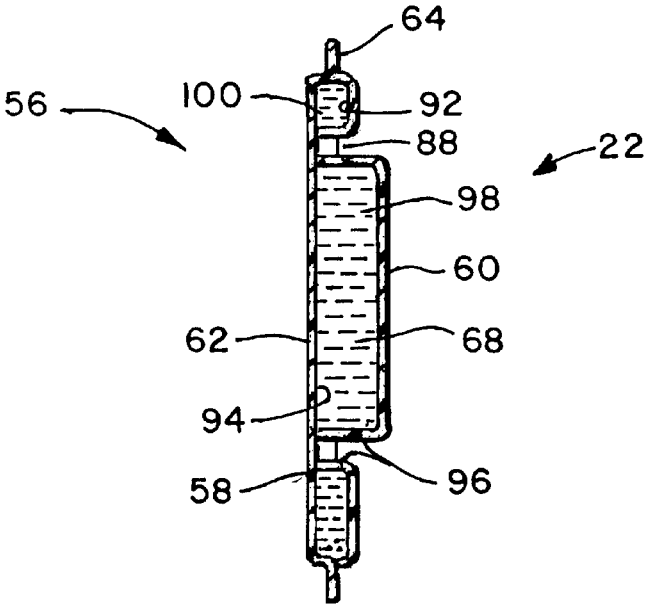
FIG. 6 is a cross-section view, taken along line 6—6, of the heel cushioning pad of FIG. 3.

In the embodiment 56 shown in FIG. 6, the lower surface 92 of the upper shell half 60 is joined to the upper surface 94 of the lower shell half 62 within the inner groove 88, forming interior side walls 96 which separate an inner cushioning pad 98 from an outer cushioning ring 100. In one embodiment, the gel-air mixture 68 in the inner cushioning pad 98 has a lower density then the gel-air mixture 68 in the outer cushioning ring 100. This produces a cushioning pad 98 which is softer than the cushioning ring 100, forming a cushioning element 56 that cups the heel.

Figure 7:
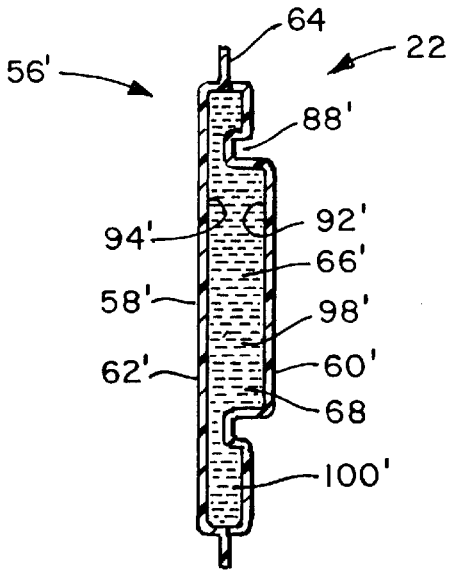
FIG. 7 is a cross-section view of an alternate embodiment of the cushioning pad of FIG. 3.

In the embodiment 56' shown in FIG. 7, the lower surface 92' of the upper shell half 60' is not joined to the upper surface 94' of the lower shell half 62' within the inner groove 88'. Consequently, the gel-air mixture 68 may move between the inner cushioning pad 98' and the outer cushioning ring 100'.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A cushioning system for a golf shoe comprising:

a footbed having a sole region, an arch region, a heel region, an upper layer engageable by a foot of a golfer, and a lower layer, the lower layer being composed of a compressible material and defining a recess in the heel region, the recess including a lower surface defining an indexing member having an inner ring extending downwardly from the lower surface of the recess and a plurality of spokes extending downwardly from the lower surface of the recess and outwardly from the inner ring;

a lasting board disposed below the footbed, the lasting board having a heel region defining a receptacle disposed oppositely the recess of the heel region of the footbed; and a cushioning element having an upper part disposed in the recess of the heel region of the footbed, a lower part disposed in the receptacle of the heel region of the lasting board, a flexible outer shell defining a cavity, and a compressible material disposed within the cavity, the compressible material of the cushioning element being more compressible than the material of the lower layer of the footbed, the outer shell including upper and lower shell halves, the upper shell half having an indexing member receiver including an inner groove having a shape which is complementary to the inner ring of the indexing member of the footbed and a plurality of outwardly extending grooves, the outwardly extending grooves each having a shape which is complimentary to a spoke of the indexing member of the footbed.

2. The cushioning system of claim 1 wherein the arch region of the footbed includes a lateral portion and a medial portion, the lower layer defines at least one receptacle in the sole region and a receptacle in the lateral portion of the arch region, and a cushioning element is disposed in each of the receptacles of the sole and arch regions of the footbed.

3. The cushioning system of claim 2 wherein each of the cushioning elements of the sole and arch regions of the footbed comprises a cover defining a cavity and a liquid disposed within the cavity.

4. The cushioning system of claim 3 wherein the liquid is selected from the group consisting of water, oil and gel.

5. The cushioning system of claim 2 wherein the lower layer of the footbed and the cushioning elements of the sole and arch regions of the footbed are each composed of EVA, the EVA having a hardness wherein the EVA of the footbed is harder than the EVA of the cushioning elements.

6. The cushioning system of claim 1 wherein the cavity is filled with an air-gel mixture.

7. The cushioning system of claim 6 wherein the upper and lower shell halves are joined along an outwardly extending seam, the seam defining a flange.

8. The cushioning system of claim 1 wherein the inner ring and inner groove each have an oblong shape.

9. The cushioning system of claim 1 wherein the upper shell half has a lower surface and the lower shell half has an upper surface, the lower surface of the upper shell half being joined to the upper surface of the lower shell half within the inner groove forming an inner cushioning pad and a separate outer cushioning ring.

10. The cushioning system of claim 9 wherein the cushioning pad and the cushioning ring are each filled with an air-gel mixture, the air-gel mixture of the cushioning pad being softer than the air-gel mixture of the cushioning ring.

11. The cushioning system of claim 9 wherein the cushioning pad and the cushioning ring are each filled with an air-gel mixture having a density, the density of the air-gel mixture of the cushioning ring being greater than the density of the air-gel mixture of the cushioning pad.

12. A cushioning system for a golf shoe comprising:

a footbed having a sole region, an arch region, a heel region, an upper layer engageable by a foot of a golfer, and a lower layer, the lower layer being composed of a compressible material and defining a recess in the heel region;

a lasting board disposed below the footbed, the lasting board having a heel region defining a receptacle disposed oppositely the recess of the heel region of the footbed; and a cushioning element having an upper part disposed in the recess of the heel region of the footbed, a lower part disposed in the receptacle of the heel region of the lasting board, a flexible outer shell including upper and lower shell halves, the upper shell half having a lower surface and the lower shell half having an upper surface, the lower surface of the upper shell half being joined to the upper surface of the lower shell half forming an inner cushioning pad and a separate outer cushioning ring, the cushioning pad and the cushioning ring each being filled with an air-gel mixture, the air-gel mixture of the cushioning pad being softer than the air-gel mixture of the cushioning ring, the air-gel mixture of the cushioning pad and the air-gel mixture of the cushioning ring each being more compressible than the material of the lower layer of the footbed.

13. A cushioning system for a golf shoe comprising:

a footbed having a sole region, an arch region, a heel region, an upper layer engageable by a foot of a golfer, and a lower layer, the lower layer being composed of a compressible material and defining a recess in the heel region;

a lasting board disposed below the footbed, the lasting board having a heel region defining a receptacle disposed oppositely the recess of the heel region of the footbed; and a cushioning element having an upper part disposed in the recess of the heel region of the footbed, a lower part disposed in the receptacle of the heel region of the lasting board, a flexible outer shell including upper and lower shell halves, the upper shell half having a lower surface and the lower shell half having an upper surface, the lower surface of the upper shell half being joined to the upper surface of the lower shell half forming an inner cushioning pad and a separate outer cushioning ring, the cushioning pad and the cushioning ring each being filled with an air-gel mixture having a density, the density of the air-gel mixture of the cushioning ring being greater than the density of the air-gel mixture of the cushioning pad, the air-gel mixture of the cushioning pad and the air-gel mixture of the cushioning ring each being more compressible than the material of the lower layer of the footbed.

* * * * *